US005470246A

United States Patent [19]

Mosquera

[11] Patent Number: 5,470,246

[45] Date of Patent: Nov. 28, 1995

[54] LOW PROFILE EDGE CONNECTOR

[75] Inventor: Rene A. Mosquera, Laguna Niguel, Calif.

[73] Assignee: ITT Industries, New York, N.Y.

[21] Appl. No.: 276,727

[22] Filed: Jul. 18, 1994

[51] Int. Cl.[6] ..... H01R 13/62

[52] U.S. Cl. ..... 439/260; 439/495

[58] Field of Search ..... 439/259–265, 439/629–637, 67, 77, 78, 79, 495

[56] References Cited

U.S. PATENT DOCUMENTS

| | | | |
|---|---|---|---|
| 3,413,594 | 11/1968 | Fernald et al. . | |
| 3,573,706 | 4/1971 | Haberlen . | |
| 3,660,803 | 5/1972 | Cooney . | |
| 4,080,027 | 3/1978 | Benasutti . | |
| 4,380,119 | 4/1983 | Normann et al. | 29/884 |
| 4,487,468 | 12/1984 | Fedder et al. . | |
| 4,626,056 | 12/1986 | Andrews, Jr. et al. . | |
| 4,639,063 | 1/1987 | Mueller . | |
| 4,826,447 | 5/1989 | Forker et al. | 439/328 |
| 4,861,272 | 8/1989 | Clark | 439/79 |
| 4,904,197 | 2/1990 | Cabourne | 439/635 |
| 5,186,632 | 2/1993 | Horton et al. | 439/629 |
| 5,295,852 | 3/1994 | Renn et al. | 439/328 |

FOREIGN PATENT DOCUMENTS 2028015 8/1979 United Kingdom .

OTHER PUBLICATIONS

IBM Technical Disclosure Bulletin, vol. 26, No. 12, May 1984; Flex Circuit Zero Insertion Force Connector; A. Burke.

*Primary Examiner*—Gary F. Paumen
*Assistant Examiner*—Hien D. Vu
*Attorney, Agent, or Firm*—Freilich Hornbaker Rosen

[57] ABSTRACT

An edge connector (12, FIG. 1) of simple construction and small thickness is provided, with a forward end which can receive a card or circuit board (14) and a rear end which can receive a pluggable connector (40), to connect contact pads (70) of the circuit board to terminals (110, 112) of the pluggable connector. The connector includes an insulative housing (16) having a rearward end portion (20) and having upper and lower cantilevered beams (22, 24). The beams extend forwardly from the rear portion, with a gap (26) between them, and with the front end (30) of the gap having an increased thickness to receive the circuit board. A flat flexible cable (34) lies in the gap, with a front (122) that is upwardly bent and received in a slot (124) of the upper beam portion, and with the forward portions of the cable conductors being exposed at their lower surfaces (164). An actuator (74) extends between the upper and lower beam portions and can be slid forwardly (F) to squeeze the beam portions together, to press the exposed conductor surfaces firmly against the conductive pads on the circuit board. The circuit board has slots (100, 102) in its edge, which receive pins (106, 108) that extend across the enlarged front end (30) of the gap.

5 Claims, 2 Drawing Sheets

10
12
14
16
18
20
22
24
26
30
32
34
40
42
44
46
50
70
72
80
82a
82b
84
86
88
94
100
102
104
106
108
110
112
120
121
122
124
130
132
134
136
140
142
160
164
U
F
R
D
X
T 12
14
16
22
24
25
26
30
32
34
40
50
60
62
64
66
70
74
94
108
110
112
120
121
122
124
130
132
134
136
140
150
H
J
F
R

FIG. 3
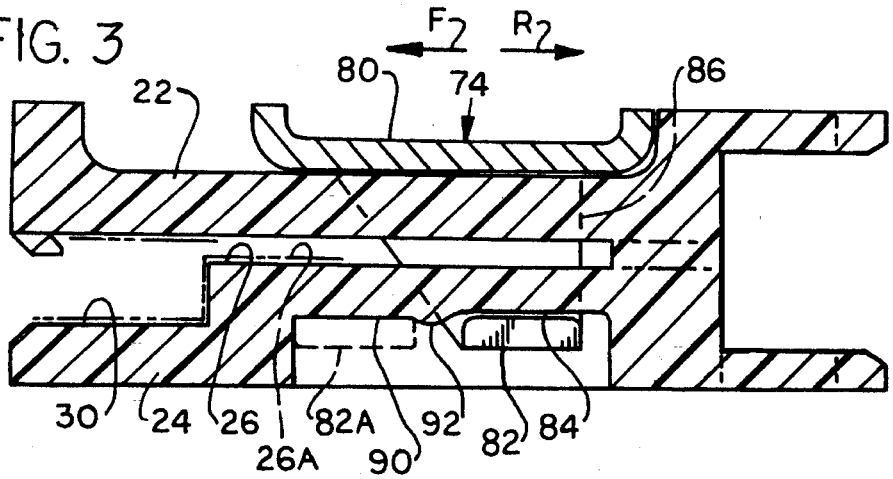
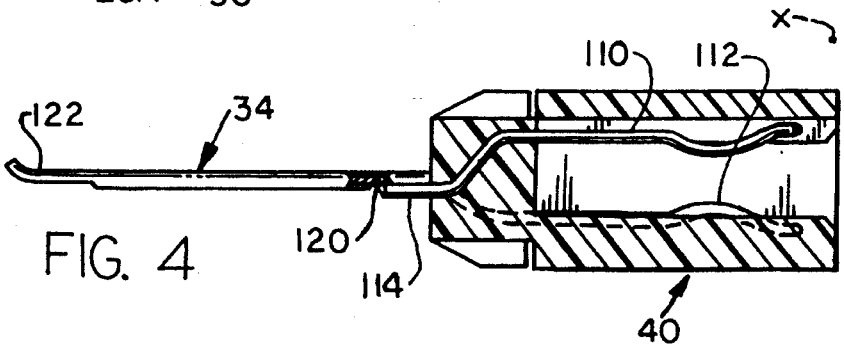
FIG. 4
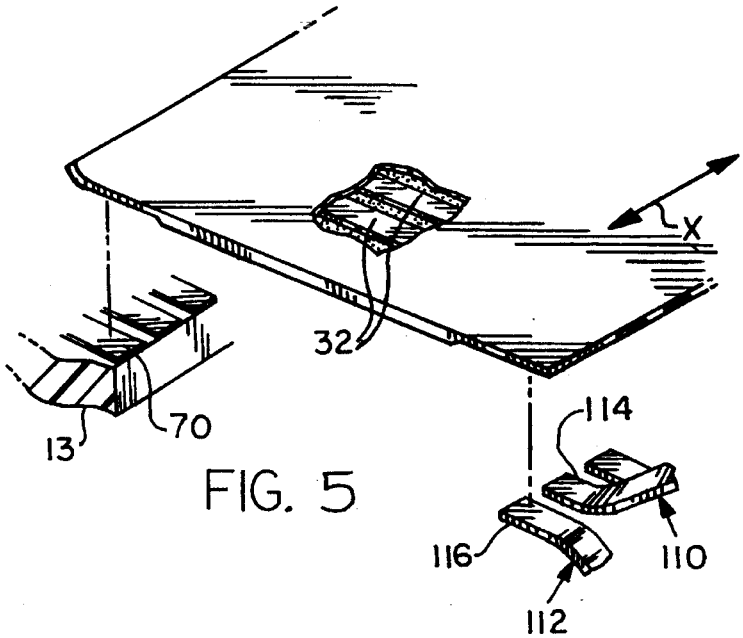
FIG. 5
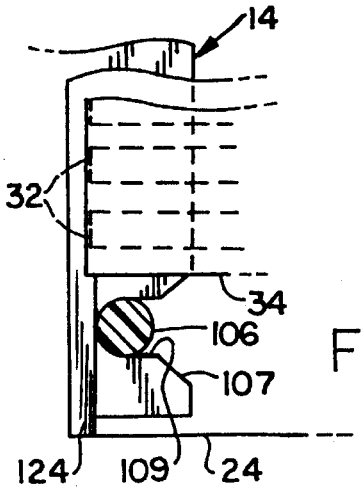
FIG. 6

LOW PROFILE EDGE CONNECTOR

BACKGROUND OF THE INVENTION

An edge connector has a slot that receives the rearward edge of a circuit board, and has at least one row of contacts that press against contact pads on the circuit board. Older edge connectors have a row of individual spring contacts that are bent to be easily deflected by an inserted circuit board and that press themselves against the pads on the board. In recent years, the spacing between contact pads on the circuit board has been decreasing, and the maximum allowable height of connectors has been decreasing. It has been difficult to use individual spring contacts because it is very difficult to accurately position and separate very small and closely spaced contacts, and to do this in a connector of small thickness. A connector of small thickness with board-mateable contacts that are closely spaced, which could be constructed at low cost, would be of value.

SUMMARY OF THE INVENTION

In accordance with one embodiment of the present invention, an edge connector is provided which is of small thickness, contains numerous closely spaced contacts, and can be constructed at low cost. The connector includes a housing having a rear end portion and having upper and lower beams extending forwardly from the rearward portion and being slightly vertically spaced to leave a gap between them. The gap has a front which is of increased thickness to closely receive an inserted rearward edge portion of a circuit board. A flat cable lies in the gap between beams, with forward portions of cable conductors being exposed to lie over contact pads of the inserted circuit board. An actuator that is mounted on the housing and coupled to the upper and lower beams, can be moved to press the beams together and thereby press the exposed conductor surfaces against contact pads on the circuit board.

The circuit board is positioned by providing a pair of alignment slots in its rearward edge which receive pins of the connector. The connector has a pair of pins that extend vertically across the thick front gap portion, so the pins fit into the circuit board slots as the circuit board is inserted.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 1, showing only the edge connector housing and showing the actuator in its released position.

FIG. 4 is a sectional view of the pluggable connector of FIG. 3.

FIG. 5 is a partial isometric view of parts of the assembly of FIG. 2, showing the flat flexible cable, contact pads of the circuit board, and contacts of the pluggable connector.

FIG. 6 is a view taken on line 6—6 of FIG. 2.

DESCRIPTION OF THE PREFERRED EMBODIMENT

Figure 1:
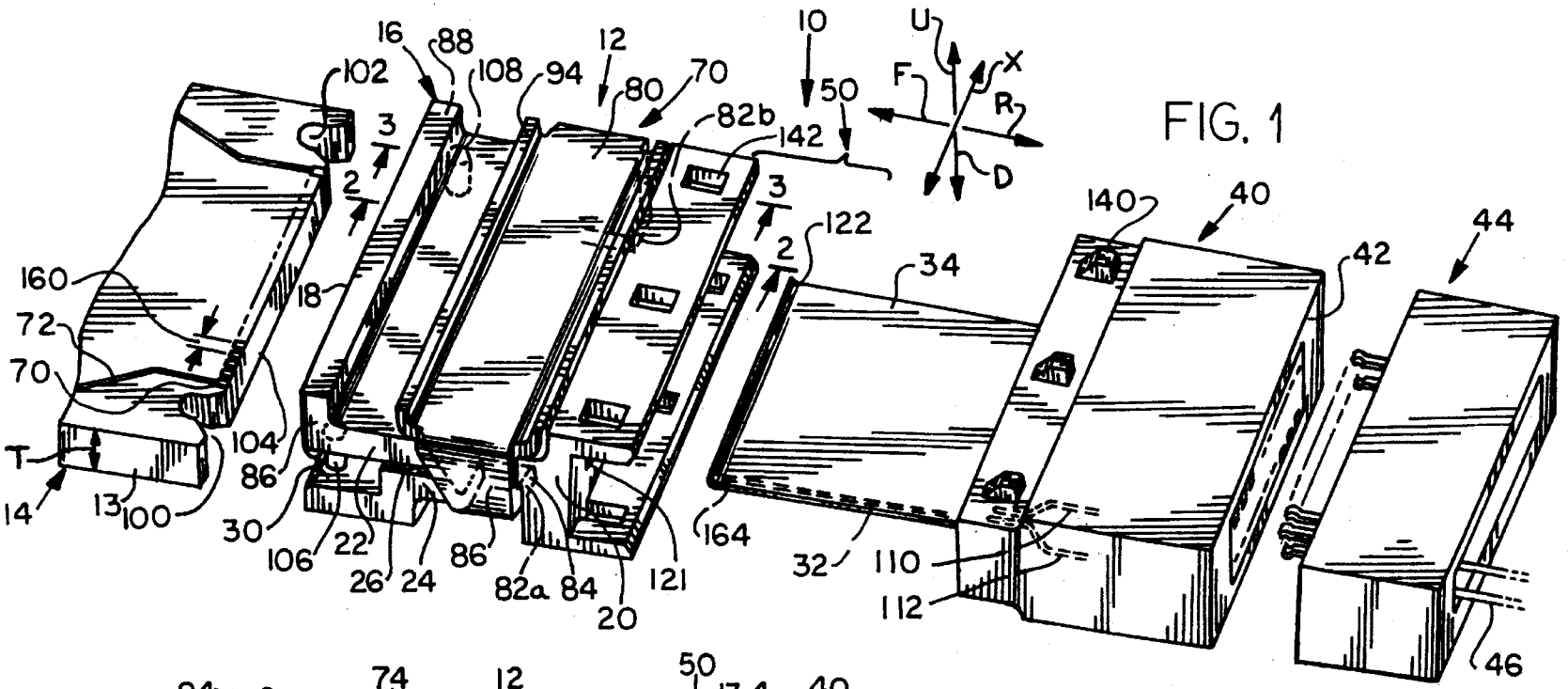
FIG. 1 is an exploded isometric view of a connector system constructed in accordance with the present invention.

FIG. 1 illustrates a connector system 10 which includes an edge connector 12 that is designed to receive a rearward portion 13 of a circuit board 14. The edge connector includes a housing 16 with longitudinally-spaced (along directions F, R) forward and rearward end portions 18, 20. The housing also includes upper and lower beams 22, 24 that are spaced in the vertical direction (along directions U, D). The beams have rear ends 25 (FIG. 2) joined to the rearward end portion, and extend in a forward direction F from the rearward end portion 20 to form cantilevered beams with a gap 26 between them. The gap includes a thick forward gap portion 30 which is of a thickness to closely receive the rearward portion 13 of the circuit board when the circuit board is moved in a rearward direction R into the gap portion. Contacts of the edge portion are formed by conductors 32 of a flat cable 34, which is preferably flexible. Although the flat cable 34 normally lies within the edge connector 12 to become part of it, FIG. 1 shows a situation occurring during construction, wherein the flat cable is initially connected to contacts of a pluggable connector 40 which can plug into the rearward end portion 20 of the edge connector. The particular pluggable connector 40 has a rear portion 42 forming a socket. The socket can receive a variety of pin connectors such as connector 44 whose rear end is connected to wires 46.

Figure 2:
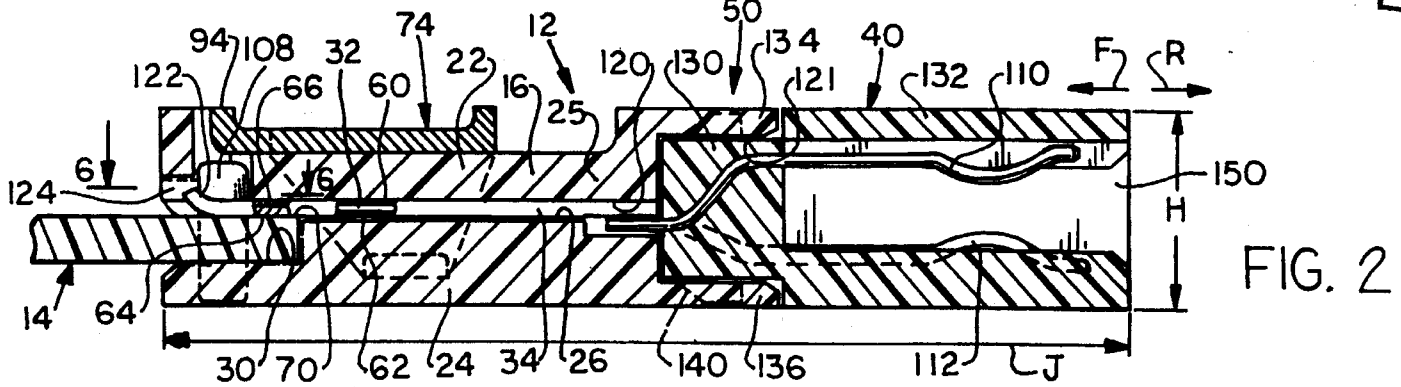
FIG. 2 is a sectional view of the edge connector, part of the circuit board, and of the pluggable connector of the connector system of FIG. 1, shown in their fully assembled position, and with the actuator in its actuated position.

FIG. 2 shows the pluggable connector 40 connected to the edge connector 12 to form an edge connector assembly 50, with the flat cable 34 lying in the gap 26 between the upper and lower beam parts 22, 24. The flat cable includes upper and lower insulation portions 60, 62 extending along most of the length of the conductors 32. However, at a front portion 66 of the cable, the front portions of the conductors are devoid of the lower insulation portion 62 to leave exposed lower surfaces 64. As shown in FIG. 1, the circuit board has a row of contact pads 70, which have traces 72 leading to other circuitry on the board. When the circuit board is inserted into the thick gap portion 30 as shown in FIG. 2, the exposed lower surfaces 64 of the cable conductor lie over the contact pads 70. With the circuit board inserted, an actuator 74 is operated to press the upper and lower beam parts 22, 24 together, and thereby press the conductor lower surfaces 64 directly against the circuit board contact pads.

As shown in FIG. 3, the actuator 74 (which is shown in its released position in FIG. 3) has an upper actuator portion 80 that lies above the upper beam 22 and a lower actuator portion 82 that lies below the lower beam 24 (below a surface part 84 of the lower beam). The actuator also includes side actuator parts 86 that lie beyond opposite sides 86, 88 (FIG. 1) of the connector housing and which connect the upper and lower actuator portions. As shown in FIG. 3, the lower beam 24 has a cam portion 90 lying forward of the lower actuator portion 82 when the actuator is in its released position of FIG. 3. When the actuator is slid in the forward direction F, it passes a stop location 92 of the cam portion 90 and slides to the forward actuated position shown at 82A. The cam portion 90 is slightly lower than the surface 84, so the actuator squeezes the upper and lower beams together to narrow the gap 26 to the position shown at 26A. The reduction in gap thickness is greatest at the forward portion 30 where the conductors and circuit board are to be pressed tightly together.

As shown in FIG. 1, the upper actuator portion 74 extends in a lateral direction X across the entire width of the connector housing. The lower actuator portion 82 includes two parts 82*a*, 82*b*. This construction facilitates mounting of the actuator, and allows for a thicker lower beam along most of its lateral width. To mate the circuit board 14 to the edge connector 12, a person grasps the circuit board 14 in one hand and the actuator 74 in his other hand, with one finger pressing against an upwardly extending flange 94 on the actuator. Very little force is required to initially install the circuit board 12 in the connector gap. Once the circuit board is installed, the person presses forwardly against the flange 94 to slide the actuator forwardly and thereby lock the circuit board in place while firmly pressing the contacts or conductors 32 of the flat cable against the circuit board contact pads.

In order to assure alignment in the lateral position X of the contact pads 70 with the forward ends of the conductors 32, applicant provides a pair of slots 100, 102 in the rear edge 104 of the circuit board. The edge connector is provided with a pair of pins 106, 108 which are closely received in the bottoms of the slots. As shown in FIG. 2, the pins such as 108 extend vertically across the thick forward gap portion 30. However, they lie on laterally opposite sides of the cable 34. Each pin is preferably fixed in place to the lower beam 24, and can slide vertically with respect to the upper beam 22. As shown in FIG. 6, each slot such as 100 has angled or tapered rear wall portions 107 and has forward parallel wall portions 109 that closely receive a pin 106.

To construct the edge connector assembly 50 of FIG. 2, applicant first attaches the flat cable 34 shown in FIG. 4, to terminals 110, 112 of the pluggable connector 40. As shown in FIG. 5, the terminals 110, 112 are staggered along the lateral direction X, and have forward tail ends 114, 116 lying in a common plane. Referring to FIG. 4, the tail ends 114, 116 are soldered to the rear ends 120 of the conductors. With the flat cables soldered to the terminals of the pluggable connector, applicant moves the pluggable connector 40 and flat cable 34 shown in FIG. 1, in the forward direction F through a housing slot 121 in the edge connector housing rearward end portion 20 and through the gap 26 to the position shown in FIG. 2. It is noted that prior to soldering the flat cable to the terminals of the pluggable connector, applicant forms the front end 122 of the cable with a sharp upward bend, even though the cable may not hold the entire bend due to moderate resilience. When the cable is inserted, its front end 122 is received in a part 124 of the upper beam, which stabilizes the vertical and lateral positions of the front end of the cable. A block part 130 of the pluggable connector housing 132 is received between flanges 134, 136 at the rear of the edge connector. Latches 140 on the top and bottom of the block 130 are received in slots 142 of the flanges to lock the pluggable connector in place.

The same edge connector 12 which is shown used with a pluggable connector 40 which has a socket rear end 150, can be used with a similar pluggable connector which has pin terminals or other male terminals at its rear end. Applicant has designed a connector of the construction shown, wherein the contact pads 70 have a pitch 160 of 25 mils (1 mil equals one thousandth inch). The edge connector assembly 50 has an overall height H of 70 mils and length J of 338 mils, with the other dimensions being relative to H and J as shown in FIGS. 2–4.

Thus, the invention provides an edge connector or edge connector assembly, which is of relatively simple construction and of low height. The edge connector includes an insulative housing with a rear portion and with upper and lower cantilevered beams extending forwardly from the rear portion. A gap between the beams holds a flat cable whose conductors form contacts, and with the front ends of the conductors having exposed lower surfaces that lie at the top of a thick front gap portion. When a circuit board is inserted into the thick front gap portion, an actuator is actuated to squeeze the upper and lower beams closer together to press the exposed contact surfaces against contact pads on the circuit board. The circuit board is aligned with the connector by providing pins on the connector that extend vertically across the thick gap portion, and that are received in slots in the rear edge of the circuit board. The circuit board resists pullout by the compression between the upper and lower beams (and the cable contacts lying below the upper beam). The actuator is slidably mounted on the housing and slides forward to cam the beams together, with the forward force keeping the circuit board in place as the beams are pressed together.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An edge connector for connecting to a circuit board rear edge portion that is of predetermined thickness and that has a plurality of contact pads, comprising;

a housing having a rearward end portion and having upper and lower cantilevered beams with rear ends that are joined to said rearward end portion, with said beams forming a gap between them that includes a forward portion of a thickness to closely receive said circuit board rear edge portion;

a flat cable having front and rear ends and lying in said housing, said cable having a plurality of parallel conductors extending in said forward and rearward directions and having insulation joining said conductors together, with said front end of said cable lying at a location between said beams and having exposed conductor lower surfaces;

an actuator mounted on said housing and coupled to said upper and lower beams, said actuator being movable along said upper and lower beams from a release position wherein said actuator allows said beams to be vertically spaced by more than said predetermined thickness at said gap forward portion, to an actuated position at which said actuator presses said beams closer together to press said exposed conductor lower surfaces against said contact pads.

2. The connector described in claim 1 wherein:

said flat cable is a flexible cable that includes a plurality of parallel conductors that extend in forward and rearward longitudinal directions, that are laterally spaced, and that have upper and lower surfaces, said cable also including insulation lying over said faces and holding said conductors so their lower faces lie substantially in a common plane;

said conductors have forward end portions with exposed lower faces, and said cable has a forward end that is upwardly bent and that is captured in said upper beam.

3. The connector described in claim 1 wherein:

said beams have laterally spaced opposite sides;

said actuator has an upper actuator portion that lies above said upper beam, a lower actuator portion that lies below said lower beam, and side actuator parts that lie beyond respective ones of said sides of said beams and that join said upper and lower actuator parts;

a cam portion positioned on said lower beam and lying forward of said lower actuator portion in said release position, so when said actuator is slid forwardly said lower actuator portion presses on said cam portion.

4. The connector described in claim 3 wherein:

said actuator upper portion extends across the entire lateral width of said housing, but said lower actuator portion has two parts that are each of a lateral length that is less than half the lateral width of said housing.

5. A method for connecting a row of contacts held in a housing, to a row of contact pads on a circuit board, comprising;

forming said housing with a rear housing portion and with vertically spaced upper and lower beams that extend forwardly from said rear housing portion and that are cantilevered so they can flex slightly together and apart, with said cantilevered beams forming a gap between them, with said lower beam having an upper surface forming a downstep at its front end to form a thick forward gap portion that is slightly thicker than said circuit board;

mounting a flat cable that includes conductors in said gap, with exposed front conductor parts lying at the top of said thick forward gap portion;

inserting said circuit board into said thick forward gap portion, and then moving an actuator along at least one of said beams to deflect that beam toward the other beam to press said exposed front conductor parts against said contact pads on said circuit board.

* * * * *